United States Patent [19]

Okamura et al.

[11] 4,368,839

[45] Jan. 18, 1983

[54] FASTENER APPLYING DEVICE HAVING A PLURALITY OF SLIDERS

[75] Inventors: Kouichi Okamura, Fukuoka; Nobuya Mizumura, Kawanishi; Ei Nigorikawa, Osaka, all of Japan

[73] Assignees: Matsushita Electric Industrial Co., Ltd., Osaka; Mabuchi Co., Ltd., Kanagawa, both of Japan

[21] Appl. No.: 197,350

[22] PCT Filed: Sep. 3, 1979

[86] PCT No.: PCT/JP79/00233

§ 371 Date: May 6, 1980

§ 102(e) Date: May 6, 1980

[87] PCT Pub. No.: WO80/00555

PCT Pub. Date: Apr. 3, 1980

[30] Foreign Application Priority Data

Sep. 12, 1978 [JP] Japan ..... 53-112595

[51] Int. Cl.[3] ..... B25C 5/02; B25C 5/16

[52] U.S. Cl. ..... 227/91; 227/96; 227/108; 227/138

[58] Field of Search ..... 227/91, 95, 96, 108, 227/129, 134, 138; 411/457, 471, 472, 473, 474, 475, 476

[56] References Cited

U.S. PATENT DOCUMENTS

| | | | |
|---|---|---|---|
| 1,554,686 | 9/1925 | Muth | 227/96 |
| 1,594,851 | 8/1926 | Polzer | 227/96 |
| 1,943,661 | 1/1934 | Ellacott | 227/96 |
| 2,674,149 | 4/1954 | Benson . | |
| 2,847,674 | 8/1958 | Wasynczuk | 227/108 |
| 2,973,175 | 2/1961 | Appleton . | |
| 3,313,463 | 4/1967 | Boucher | 227/108 |
| 3,908,850 | 9/1975 | Jureit et al. . | |

FOREIGN PATENT DOCUMENTS

| | | | |
|---|---|---|---|
| 35-6762 | 4/1960 | Japan . | |
| 42-2160 | 2/1967 | Japan . | |
| 44-11317 | 5/1969 | Japan . | |
| 49-11103 | 3/1974 | Japan . | |
| 90684 | 9/1921 | Switzerland | 227/96 |

*Primary Examiner*—Howard N. Goldberg
*Assistant Examiner*—Fred A. Silverberg
*Attorney, Agent, or Firm*—Joseph W. Farley

[57] ABSTRACT

This invention relates to a device for fixing fasteners to the flaps of corrugated cardboard boxes for sealing the flaps. With the fastener placed across the adjoining edges of at least two flaps, piercing nails in the form of a cow horn and attached to a pair of turnable pieces on the fastener are driven into the flaps by the device. The device is characterized in that two reciprocally movable sliders (12, 13) move to drive a cutting blade (17), causing the blade to separate a fastener from other fasteners, and subsequently drive pivotal members (29*a*, 29*b*) to depress the turnable pieces on the fastener, driving the piercing nails into the flaps. Fasteners can be fixed in place easily and reliably.

8 Claims, 7 Drawing Figures

FASTENER APPLYING DEVICE HAVING A PLURALITY OF SLIDERS

TECHNICAL FIELD

This invention relates to a device for fixing fasteners to the flaps of corrugated cardboard packaging boxes to seal the flaps.

BACKGROUND ART

The flaps of corrugated cardboard packaging boxes are sealed usually by affixing a sealing tape to the joint of the flaps or by driving staples into the flap joint with a boxer. When the flaps sealed by such a method are opened, the flaps become damaged on the surface and require the use of a new sealing tape or staples for resealing. Although a method of fastening by reeving a string around tacks with disks is adapted for easy resealing, it takes some time to fix the disk holding tacks in place, and the method has another drawback that the fastening means is easily removable during the transport or handling of the package, failing to seal the package reliably.

In view of these problems, a fastener has been developed which facilitates sealing and opening of packages and which is reusable. FIG. 1 shows the construction of the fastener. The fastener comprises a flat main plate 1 as its main body and a pair of turnable pieces 2*a*, 2*b* hingedly connected at a thin wall portion to the flat main plate. The pair of turnable pieces 2*a*, 2*b* can be raised from the surface of the main plate 1 and turned to the position flush with the surface. When the pieces 2*a*, 2*b* are so turned, the forward ends of the pieces 2*a*, 2*b* slightly project beyond the ends of the main plate 1. The projecting portions serve as knobs. The main plate 1 has recesses 3*a*, 3*b* into which the pair of turnable pieces 2*a*, 2*b* are fittable respectively when turned downward. Apertures 4*a*, 4*b* are formed in the main portions of the recesses 3*a*, 3*b*. The turnable pieces 2*a*, 2*b* are provided with sharpened piercing nails 5*a*, 5*b* on their lower sides. The piercing nails 5*a*, 5*b* are opposed to the apertures 4*a*, 4*b* and are each in the form of a cow horn curved toward the center. Engaging pieces 6*a*, 6*b* on the rear sides of the turnable pieces 2*a*, 2*b* are engageable with engagement projections 7*a*, 7*b* on the inner side edges of the recessed portions 3*a*, 3*b* of the main plate 1. These portions are made integrally from a flexible synthetic resin, such as polypropylene. A large number of such fasteners are connected together by connectors 8.

As seen in FIG. 2, the faster is placed across the opposed edges of flaps 9*a*, 9*b* of a corrugated cardboard packaging box. When the turnable pieces 2*a*, 2*b* are turned and pressed downward as shown in FIG. 3, the piercing nails 5*a*, 5*b* are driven through the flaps 9*a*, 9*b* and an underlying flap 9*c* to fasten the flaps 9*a*, 9*b* and 9*c* together as held between the lower side of the main plate 1 and the nails, whereby the flaps 9*a*, 9*b* are sealed. To open the flaps 9*a*, 9*b*, the fastener is removable by raising the turnable pieces 2*a*, 2*b* at the knob end portions and thereby withdrawing the piercing nails 5*a*, 5*b* from the flaps 9*a*, 9*b*, 9*c*. The fastener is reusable in the same manner as above for resealing.

Such fasteners are inefficient to use for sealing if handled individually, so that it is desired to connect together a large number of fasteners and attach them in place one after another by some device.

DISCLOSURE OF THE INVENTION

The present invention provides a device by which fasteners comprising a main plate and turnable pieces attached to the main plate as described above can be fixed to packaging boxes with ease, the device comprising two reciprocally movable sliders, one of the two sliders being at least provided with a blade for cutting the connectors between the fasteners, the other slider being provided with pivotal members which are turnable outwardly downward each as supported at a lower portion thereof for depressing the turnable pieces on the fastener, the cutting blade being cooperative with the pivotal members.

BEST MODE OF CARRYING OUT THE INVENTION

Figure 1:
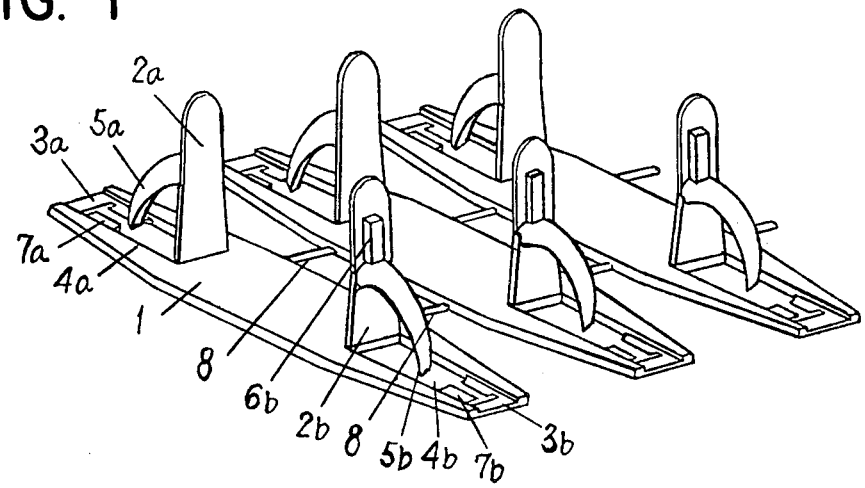
FIG. 1 is a perspective view showing fasteners useful for the fixing device of this invention.
Figure 2:
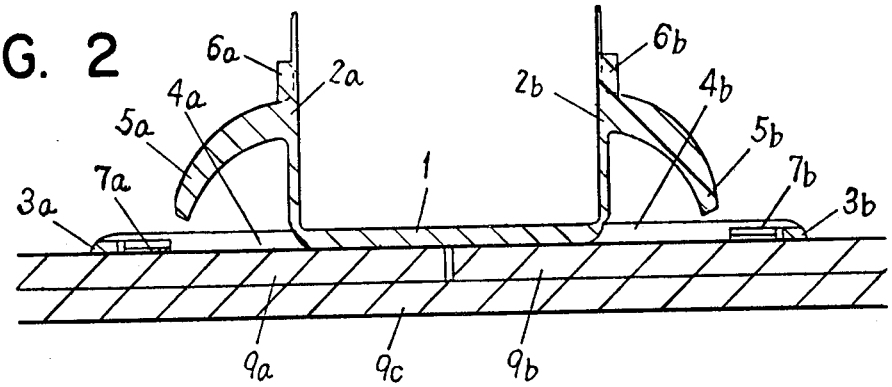
FIGS. 2 and 3 are views illustrating how the fastener is fixed in place.
Figure 3:
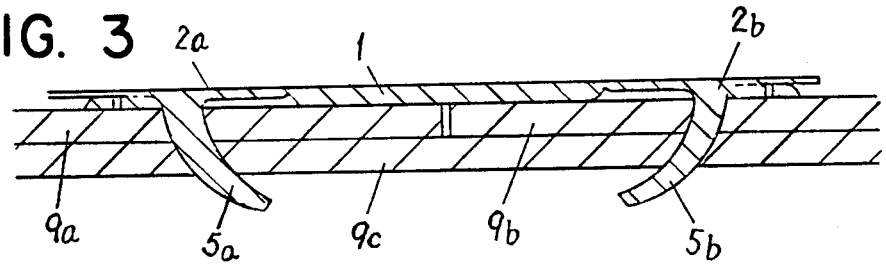
Figure 4:
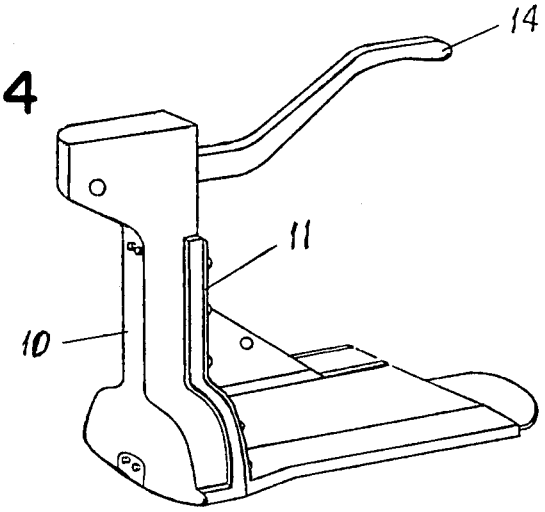
FIG. 4 is a perspective view showing the fastener fixing device embodying the invention.
Figure 5:
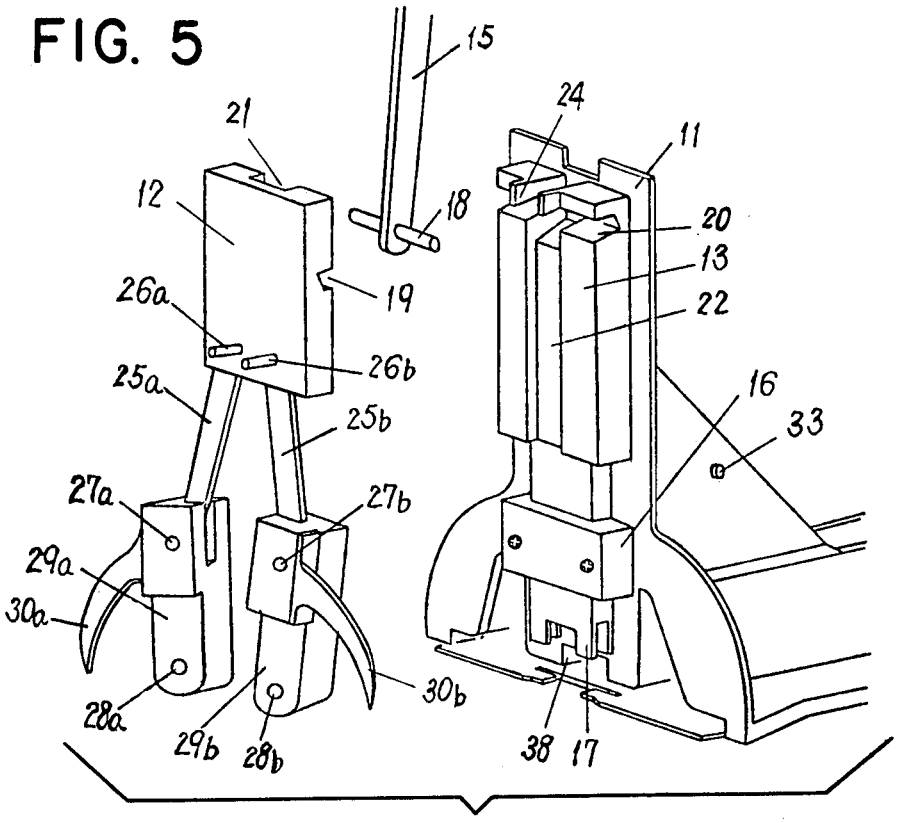
FIG. 5 is a perspective view showing part of the internal construction of the device.

With reference to the embodiment shown in FIGS. 4 to 7, indicated at 10 is a hollow front frame having an outwardly bulged lower portion, and at 11 a rear frame in the form of a flat plate. Both frames 10, 11 are joined together to form the main framework of a drive assembly. The main framework houses two sliders 12, 13 individually movable up and down and fitting to each other with one disposed in front of the other. Pivoted to the front frame 10 is a handle 14, which, when moved upward or downward, drives the sliders 12, 13 through a drive bar 15 and by means of the mechanism to be described later. A channel-shaped stopper 16 is attached to the rear frame 11 for passing part of the slider 13 therethrough and restraining the slider 13 from downward movement. The slider 13 is formed, at its lower end, with a cutting blade 17 which is directed downward. The sliders 12, 13 are provided on their inner sides with horizontal grooves 19, 20 for selectively receiving an engaging pin 18 on the drive bar 15, vertical central grooves 21, 21 and projections 23, 24 each slidable in one of the vertical grooves 21, 22 opposed thereto. The upper wall defining the horizontal groove 19 is inclined upward, while the lower wall defining the other horizontal groove 20 is inclined downward. Two links 25*a*, 25*b* are pivoted at their upper ends to a lower portion of the slider 12 by pins 26*a*, 26*b*. The lower ends of the links 25*a*, 25*b* are pivoted at support points 27*a*, 27*b* to the upper ends of two pivotal members 29*a*, 29*b* respectively. The two pivotal members 29*a*, 29*b* have their lower ends supported by pivots 28*a*, 28*b* on the front frame 10 and are outwardly turnable about the pivots 28*a*, 28*b* within the front frame 10. The pivotal members 29*a*, 29*b* are provided on their outer sides with sharp-ended, flap piercing holders 30*a*, 30*b* each in the form of a cow horn curved toward the center.

Figure 6:
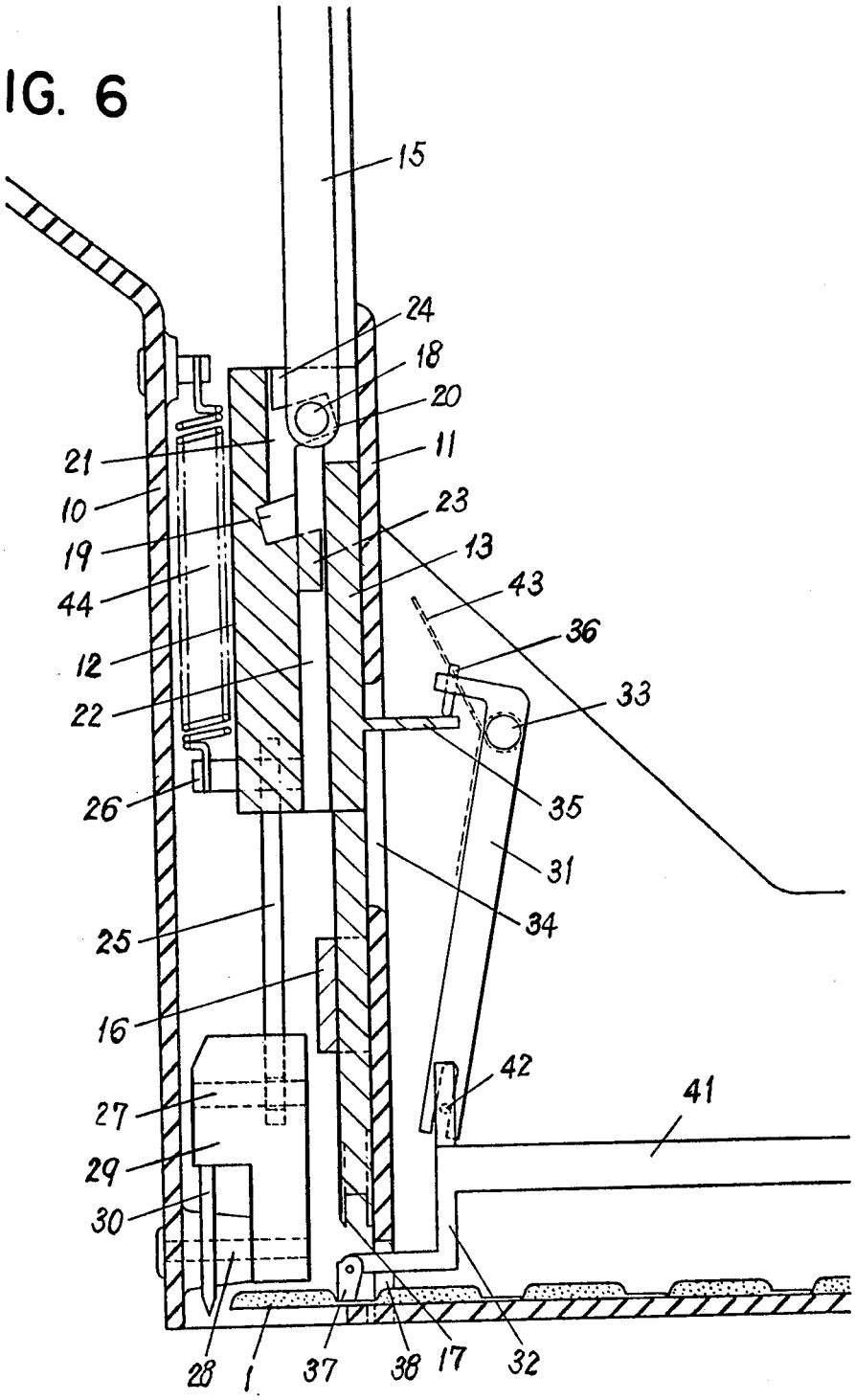
FIG. 6 is a side elevation schematically showing the device in section.
Figure 7:
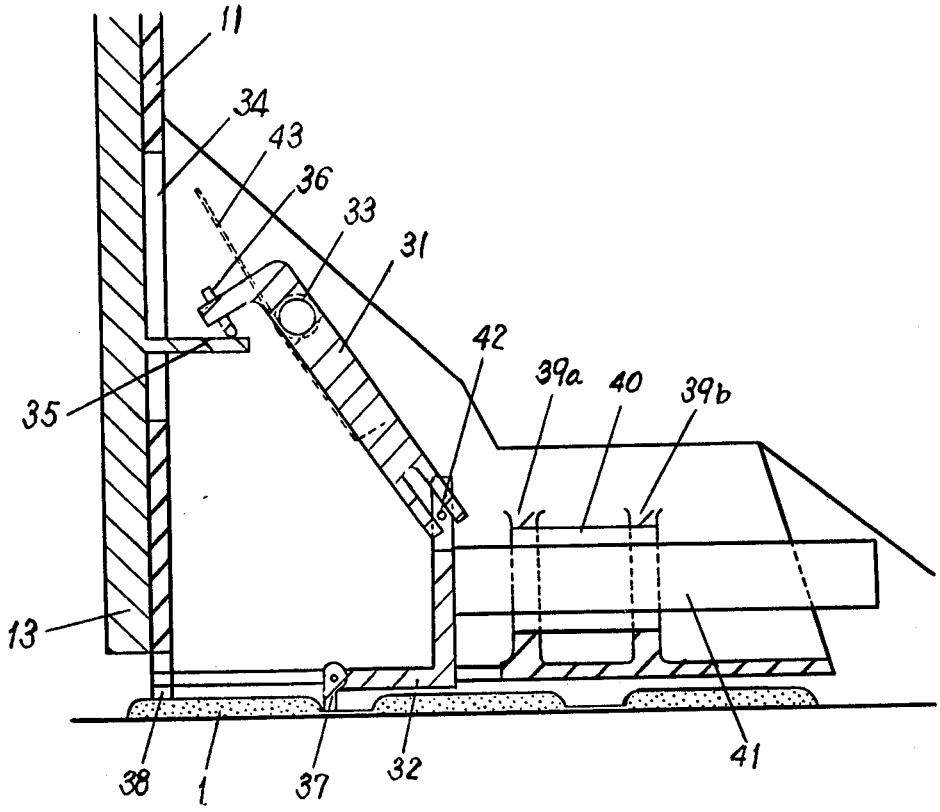
FIG. 7 is a side elevation in section showing a fastener feeding mechanism of the device.

The rear frame 11 is in combination with a fastener feeding mechanism which consists essentially of an L-shaped cam 31 and a feed lever 32 as shown in FIGS. 6 and 7. The L-shaped cam 31 is supported at its corner portion by a pivot 33 on the rear frame 11 and has at its upper end a pin 36 bearing on a projection 35 attached to the slider 13 and extending outward through an opening 34 in the rear frame 11 behind the slider 13. Accordingly the slider 13, when moved up and down, turns the L-shaped cam 31 to move its lower end. The feed lever 32 is positioned horizontally and has a front end carrying a feed pawl 37. The front end is adapted to be guided through an opening 38 in the lower end of the rear frame 11 into the space surrounded by the front frame 10 and the rear frame 11. The rear end of the feed lever 32 is connected to a feed rod 41 extending through a slide bearing 40 fitted in ribs 39*a*, 39*b* within the rear frame 11 and is also coupled to the lower end of the L-shaped cam 31 by an engaging pin 42. Thus the pivotal movement of the L-shaped cam 31 moves the lever 32 horizontally in reciprocation.

The fastener fixing device of this invention having the above construction operates in the following manner. FIG. 6 shows the fixing device of this invention in which a number of fasteners shown in FIG. 1 are placed, with the sliders 12, 13 raised by the handle 14 and a fastener guided in position. In this state, the engaging pin 18 on the drive rod 15 is fitted in the horizontal groove 20 of the rear slider 13. When the handle 14 is depressed, the drive bar 15 first moves down the slider 13 with its engaging pin 18. At this time, the cutting blade 17 attached to the lower end of the slider 13 and the rearwardly projecting projection 35 also move down. The L-shaped cam 31 with its pin 36 bearing on the projection 35 starts to turn counterclockwise about the pivot 33 under the restoring action of a coiled spring 43. The feed lever 32 and the feed rod 41 which are connected to the cam 31 move rightward and, at the same time, the feed pawl 37 also moves rightward with the feed lever 32 in a substantially horizontal position. With a further downward movement of the slider 13, the cutting blade 17 cuts the connectors 8 of the fastener, whereupon the slider 13 is restrained from moving down by the stopper 16. Approximately simultaneously with this, the engaging pin 18 of the drive bar 15 slides along the lower inclined wall defining the horizontal groove 20 in the rear slider 13 and engages in the horizontal groove 19 in the opposed front slider 12, consequently bringing the slider 12 into downward movement to cause the links 25*a*, 25*b* to turn the pivotal members 29*a*, 29*b* outwardly downward. The flap piercing holders 30*a*, 30*b* on the outer sides of the pivotal members 29*a*, 29*b* are driven into the flaps of a packaging box by this movement. With a further downward movement of the slider 12, the pivotal members 29*a*, 29*b* act to depress the forward ends of the turnable pieces 2*a*, 2*b* of the fastener. As a result, the piercing nails 5*a*, 5*b* projecting from the lower sides of the turnable pieces 2*a*, 2*b* pierce the flaps. At this time, the flap piercing holders 30*a*, 30*b* have already been driven deep into the flaps, holding the flaps pulled toward each other and permitting the pivotal members 29*a*, 29*b* to depress the turnable pieces 2*a*, 2*b* in a stabilized position. Subsequently the engaging pieces 6*a*, 6*b* on the turnable pieces 2*a*, 2*b* come into engagement with the projections 7*a*, 7*b* on the main plate 1, whereby the fastener is completely fixed in place.

When the handle 14 is thereafter moved upward, a tension spring 44 provided between the slider 12 and the front frame 10 acts to contract, assisting in the upward movement of the slider 12. The slider 12 finishes its upward movement, returning the pivotal members 29*a*, 29*b* and the holders 30*a*, 30*b* to their original positions, whereupon the engaging pin 18 on the drive bar 15 slides along the upper inclined wall defining the horizontal groove 19 and engages in the horizontal groove 20 in the opposed slider 13, initiating the slider 13 into upward movement. This movement turns the L-shaped cam 31 clockwise by the projection 35 and moves the feed lever 32 leftward. The feed pawl 37 now in a vertical position strikes a side portion of the main plate 1 of the next new fastener to set the fastener in place.

INDUSTRIAL APPLICABILITY

Fasteners having turnable pieces with piercing nails can be fixed to corrugated cardboard boxes by the device of this invention described very effectively and reliably to effectively seal the boxes. A large number of fasteners connected together can be attached in place successively. Thus the device has the outstanding advantage of achieving improved work efficiency.

We claim:

1. A device for applying to an article such as a packaging box a fastener having a flat main plate and a pair of turnable pieces hingedly connected to the main plate and each having a piercing nail, the device comprising:

a framework;

a first slider reciprocably carried by the framework and having an outer end provided with a cutting blade adapted to cut the fastener from a strip of connected fasteners;

a second slider reciprocably carried by the framework, a pair of pivotable members carried by the framework and adapted to engage the pair of turnable pieces of a fastener, and means for pivoting the pair of members in response to reciprocating movement of the second slider;

and means for driving the first and the second sliders one at a time in succession on fastener cutting and applying movements, respectively, whereby a fastener is cut from the strip of fasteners by the cutting blade of the first slider and the turnable pieces of the cut fastener are thereafter engaged and moved by the pair of pivotable members to force the piercing nails into the article.

2. A fastener applying device as defined in claim 1 wherein each of the pair of pivotable members is provided with an article piercing holder adapted to be driven into the article prior to the application of the fastener thereto.

3. A fastener applying device as defined in claim 1 wherein each of the pair of pivotable members includes a portion engageable with one turnable piece of a fastener, and an article piercing holder adjacent to and projecting outwardly from said portion for engagement with the article prior to the application of the fastener thereto.

4. A fastener applying device as defined in claim 2 or 3 wherein the pivotable members are pivoted in opposite directions in response to movement of the second slider, and the article piercing holder is curved in the direction of movement of the pivotable member associated with the article piercing holder, the article piercing holders of the pair of pivotal members being adapted to engage and position adjacent flaps of a packaging box for the application of a fastener thereto.

5. A fastener applying device as defined in claim 4 wherein:

the first and the second sliders are respectively provided with first and second adjacent sides facing each other; and the means for driving the first and the second sliders comprise a movable drive bar, first and second recesses respectively formed in said first and the second sides and being drivingly engageable by the drive bar, the second recess being spaced from the first recess in the direction of driving movement of the drive bar, and means for stopping movement of the first slider at the end of the cutting operation thereof with the first recess in opposed alignment with the second recess whereby the driving bar is shiftable from the first to the second recess.

6. A fastener applying device as defined in claim 1 wherein:

the first and the second sliders are respectively provided with adjacent oppositely facing sides having first and second oppositely facing grooves extending in the direction of driving movement of the sliders; and, the said means for driving the sliders comprises a movable drive bar having a driving abutment, first and second recesses in the oppositely facing sides of the first and the second sliders, respectively, said recesses being drivingly engageable by the driving abutment, the second recess being displaced from the first recess in the direction of driving movement, means for stopping such movement of the first slider at the end of the fastener cutting operation thereof with the first and the second recesses in opposed alignment, the second recess including a portion projecting into the first groove and adapted to be engaged by the drive bar for shifting the driving abutment from the first to the second recess.

7. A fastener applying device as defined in claim 6 wherein the first recess includes a portion projecting into the second groove for shifting the driving abutment from the second to the first recess on return movement of the drive bar.

8. A fastener applying device as defined in claim 1 or 6 further comprising a feed lever reciprocably movable in response to reciprocation of the sliders and having a feed pawl for successively feeding fasteners to a cutting and applying position.

* * * * *